US011686102B2

(12) United States Patent
Sprague

(10) Patent No.: US 11,686,102 B2
(45) Date of Patent: Jun. 27, 2023

(54) RAILING BASE SHOE AND WEATHER SEAL SYSTEM AND METHOD

(71) Applicant: Gary Sprague, Visalia, CA (US)

(72) Inventor: Gary Sprague, Visalia, CA (US)

(73) Assignee: Frameless Hardware Company, LLC, South Gate, CA (US)

( * ) Notice: Subject to any disclaimer, the term of this patent is extended or adjusted under 35 U.S.C. 154(b) by 244 days.

(21) Appl. No.: 17/112,243

(22) Filed: Dec. 4, 2020

(65) Prior Publication Data

US 2021/0254346 A1 Aug. 19, 2021

Related U.S. Application Data

(60) Provisional application No. 62/943,743, filed on Dec. 4, 2019.

(51) Int. Cl.
*E04F 11/18* (2006.01)

(52) U.S. Cl.
CPC ..... *E04F 11/1812* (2013.01); *E04F 11/1853* (2013.01)

(58) Field of Classification Search
CPC ..... E04F 11/1812; E04F 11/1817; E04F 11/1853
See application file for complete search history.

(56) References Cited

U.S. PATENT DOCUMENTS

| | | | | |
|---|---|---|---|---|
| 8,820,721 | B1 * | 9/2014 | Poma | E04H 9/14 256/65.14 |
| 9,074,413 | B1 * | 7/2015 | Sprague | E06B 3/5871 |
| 10,697,170 | B1 * | 6/2020 | Mazzola Vernengo | E04F 11/1804 |
| 10,876,297 | B1 * | 12/2020 | Poma | E04F 11/1812 |
| 2004/0128931 | A1 * | 7/2004 | Sprague | E06B 3/5454 52/480 |
| 2018/0112434 | A1 * | 4/2018 | Sprague | E04F 11/1853 |

FOREIGN PATENT DOCUMENTS

| | | | | |
|---|---|---|---|---|
| DE | 202019000149 | U1 * | 5/2020 | E04F 11/1812 |
| DE | 202019003306 | U1 * | 12/2020 | E04F 11/1817 |
| DE | 102019005576 | A1 * | 2/2021 | E04F 11/1812 |
| EP | 3179007 | A1 * | 6/2017 | E04F 11/1812 |
| EP | 3617419 | A1 * | 3/2020 | E04F 11/1817 |

* cited by examiner

*Primary Examiner* — Joshua T Kennedy
(74) *Attorney, Agent, or Firm* — Cohen IP Law Group, PC; Michael N. Cohen

(57) ABSTRACT

A system and method for waterproofing the interface between a base shoe and a panel is provided. The system includes a weather seal adapted to extend between an inner side wall of the base shoe and an adjacent surface of the panel to seal the gap therebetween. The system includes an elongate groove formed in the inner side wall at a downward offset angle and including a groove entrance that is accessible from directly above. The weather seal includes a foot adapted to be received into the elongate groove when the seal is configured to seal the gap. In this way, the seal may be installed from above and the seal's foot may be pressed into the groove via the groove entrance to secure the seal in place.

17 Claims, 10 Drawing Sheets

RAILING BASE SHOE AND WEATHER SEAL SYSTEM AND METHOD

RELATIONSHIPS TO PRIOR APPLICATIONS

This application claims priority to U.S. Provisional Application No. 62/943,743, filed Dec. 4, 2019, the entire contents of which are hereby fully incorporated herein by reference for all purposes.

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

This invention relates to railings, including railing base shoes and corresponding weather seal systems.

BACKGROUND

Outdoor glass guard railings used in hotels and other outdoor areas are aesthetically pleasing and quite functional. The railings typically include a base shoe member at the bottom that secures and holds the vertical glass panel in place.

Weather seals between the glass panel and the base shoe are used to keep moister and other elements from entering the base shoe and causing corrosion and other problems.

However, the installation of weather seals using current systems in use include several shortcomings. For example, some systems require for the weather seals to be installed after the installation of the glass panel, thereby requiring the installer (glazier) to lean over the glass panel to install the outer facing seal. This task is obviously dangerous when the area outside the guard rail is above ground level.

In another example, some systems provide a first seal to be installed prior to the installation of the glass panel (e.g., an outer seal thus eliminating the danger of leaning over the railing) and a second seal that is installed after the installation of the glass (e.g., an inner seal). However, these systems require the glazier to stock and carry two different types of seals, thereby increasing inventory and cost.

Accordingly, there is a need for a railing base shoe and weather seal system that allows for the weather seals to be installed prior to or after the installation of a glass railing, and that do not require the glazier to stock and carry more than one type of weather seal.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

As used herein, unless used otherwise, the following terms and abbreviations have the following meanings:

Outboard means towards the outside, and in the case of a guard railing or panel, towards the area outside a guard railing or panel.

Inboard means towards in the inside, and in the case of a guard railing or panel, towards the area inside a guard railing or panel.

Lateral means towards the side, and in the case of a guard railing or panel, facing away from the middle (the median plane) of the guard railing or panel.

Medial means towards the middle, and in the case of a guard railing or panel, facing towards the middle (the median plane) of the guard railing or panel.

In general, the system according to exemplary embodiments hereof provides a base shoe member for supporting a panel (e.g., a glass panel), and a system of weather seals providing weather-proof communication between the base shoe and the glass panel. The base shoe member includes a longitudinal channel within which the glass panel is mounted. The weather seals seal the junction between the base shoe and the glass panel so that moister and other elements are prevented from entering into the base shoe.

Referring now to FIGS. 1-8, the system 10 according to exemplary embodiments hereof will be described in further detail.

Figure 1:
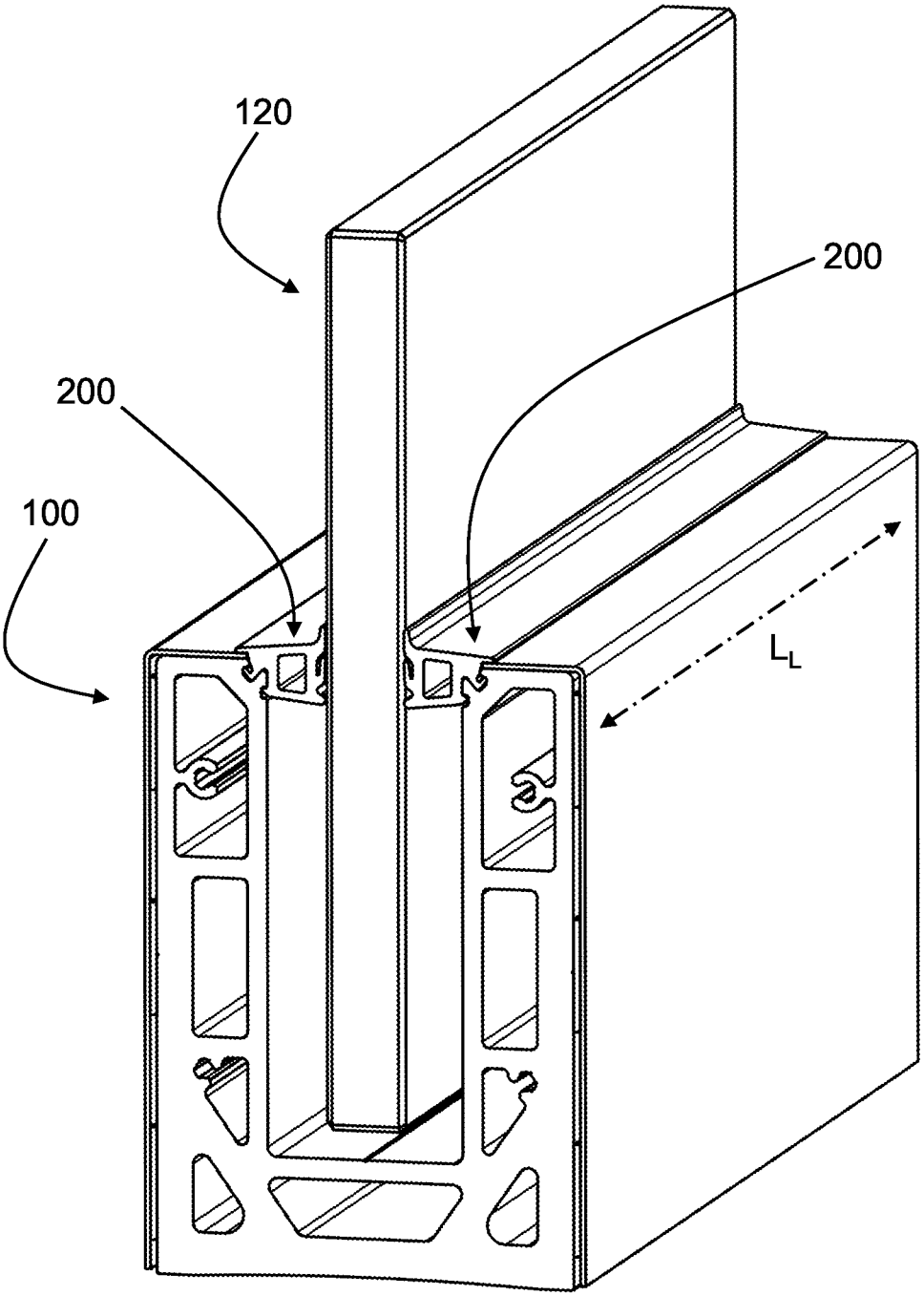
FIGS. 1-2 show aspects of a panel base shoe and weather seal system according to exemplary embodiments hereof.
Figure 2:
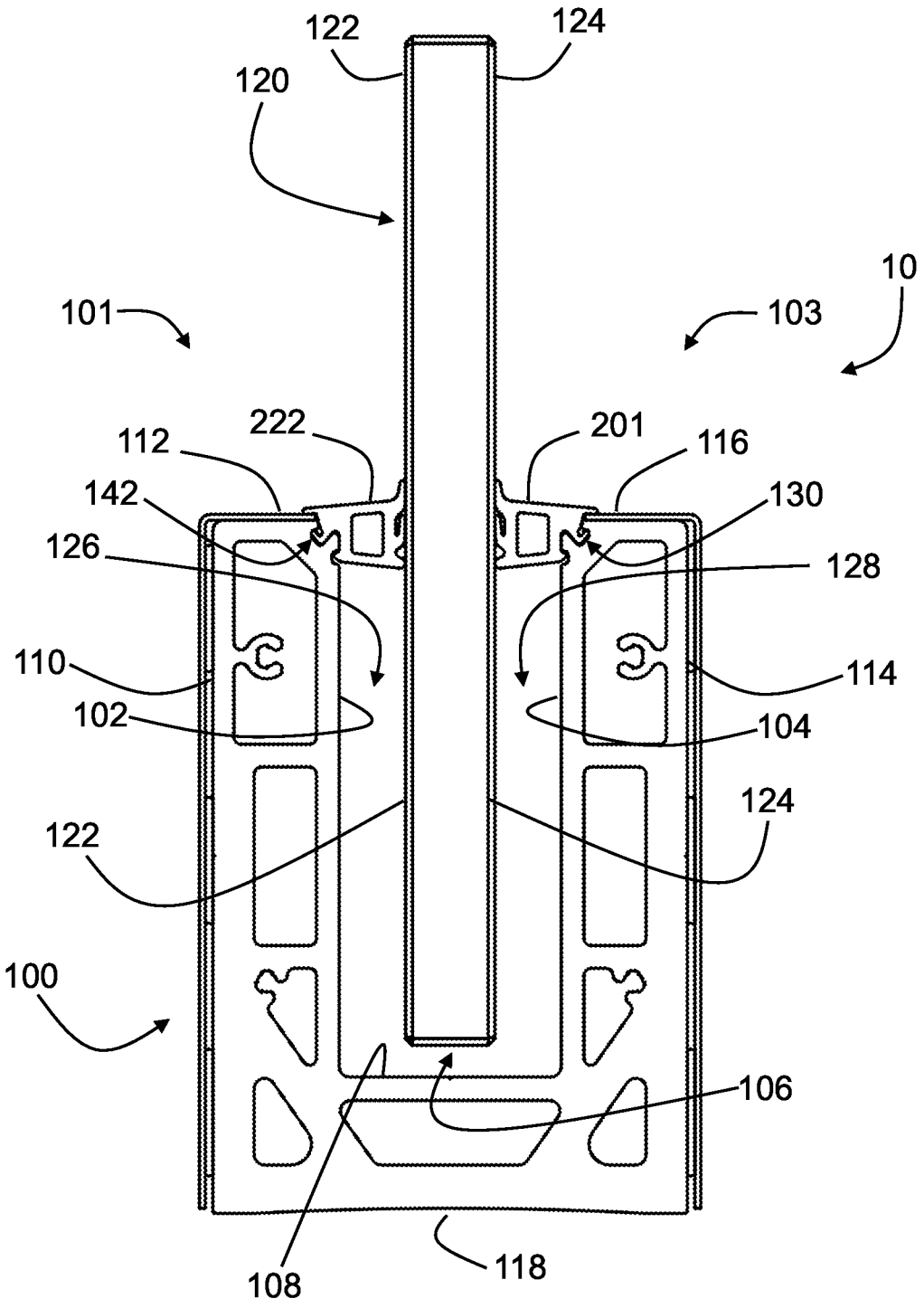

In one exemplary embodiment hereof as shown in FIGS. 1 and 2, the system 10 includes a base shoe member 100 and one or more weather seals 200. The base shoe member 100 may comprise aluminum or other materials and may be formed using an extrusion process. The base shoe 100 is generally adapted to receive and support the bottom portion of a panel 120.

The base shoe member 100 includes an outboard inner wall 102 and an inboard inner wall 104, and an inner channel 106 defined between the walls 102, 104. The outboard and inboard inner walls 102, 104 are generally vertical or at a slight offset angle. Bottom inner wall 108 is generally horizontal (although it may include one or more curvatures), and joins the outboard and inboard inner walls 102, 104 to define the bottom of the inner channel 106.

The outboard outer wall 110 defines the outboard side of the base shoe 100, and the outboard top surface 112 defines the top outboard side of the base shoe 100. The combination of the outboard inner wall 102, the outboard outer wall 110, and the outboard top surface 112 defines the base shoe member's outboard portion 101.

The inboard outer wall 114 defines the inboard side of the base shoe 100, and the inboard top surface 116 defines the top inboard side of the base shoe 100. The combination of the inboard inner wall 104, the inboard outer wall 114, and the inboard top surface 116 defines the base shoe member's inboard portion 103.

The bottom 118 joins the outboard outer wall 110 and the inboard outer wall 114 and defines the bottom of the base shoe 100.

The base shoe 100 is adapted to receive and support the bottom portion of a panel 120. In some embodiments the panel 120 may be glass (e.g., a glass pane or door), but other materials may also be used. The glass panel 110 may be oriented vertically with its bottom portion received into the inner channel 106. In this configuration, the glass panel 120 includes an outboard lateral surface 122 and an inboard lateral surface 124. The glass panel 120 may be secured within the channel 106 using mechanical mechanisms (e.g., clamps), a wet seal (e.g., cement or epoxy) or other securing means.

With the glass panel 120 received into the inner channel 106 as shown in FIG. 1, an outboard gap 126 may exist between the outboard lateral surface 122 of the glass panel 110 and the outboard inner wall 102 of the base shoe 100. In addition, an inboard gap 128 may exist between the inboard lateral surface 124 of the glass panel 110 and the inboard inner wall 104 of the base shoe 100.

Figure 3A:
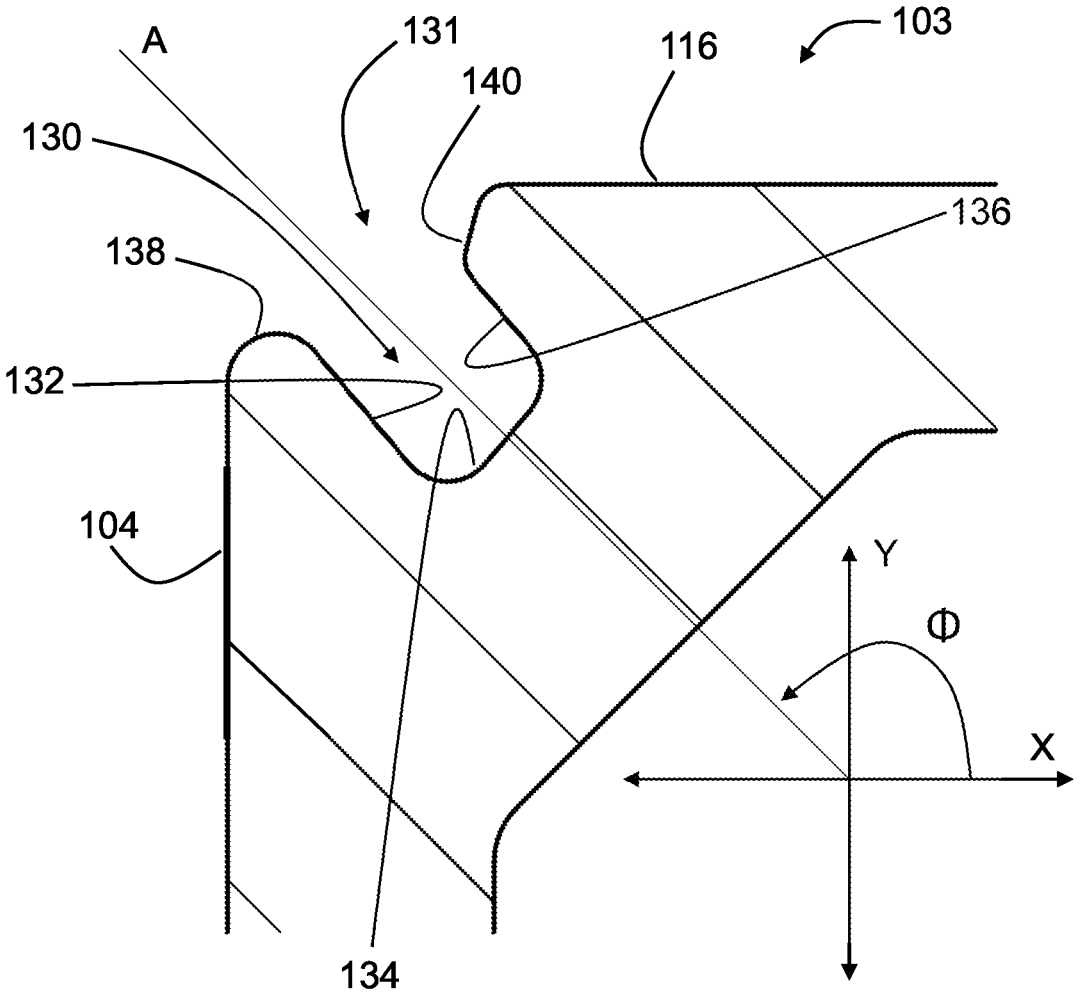
FIGS. 3A-3C show aspects of a seal retaining groove according to exemplary embodiments hereof.

In one exemplary embodiment hereof as shown in FIGS. 2 and 3A, a first seal retaining elongate groove 130 including a first groove entrance 131 is positioned at the intersection of the inboard inner wall 104 and the inboard top surface 116. The first seal retaining groove 130 includes a lower wall 132, a back wall 134 and an upper wall 136 that generally define the groove 130. As will be described in other sections, the first seal retaining groove 130 is adapted to receive and secure a portion of a first weather seal 201. Accordingly, it is preferable that the first seal retaining groove 130 extend along the longitudinal length (as represented by the axis $L_L$ in FIG. 1) of the base shoe member 100. However, it is understood that the first seal retaining groove 130 may extend along separate and/or individual portions of the base shoe member's longitudinal length.

In one exemplary embodiment hereof, the groove's lower wall 132 and upper wall 136 are generally parallel with respect to one another and are oriented at an inclined angle Φ (represented by line A) with respect to the X-Y axis. In some embodiments, the angle Φ is 135° from the horizontal (X-axis). In some embodiments, the angle Φ is in the range of 110°-160° from the horizontal (X-axis). In some embodiments, the back wall 134 of the groove 130 is generally linear and at a right angle with respect to the groove's lower wall 132 and upper wall 136. However, it is understood that the back wall 134 may include one or more curvatures, angular orientations and/or other forms that may not necessarily be at right angles with respect to the lower and upper walls 132, 136. It is also understood that lower wall 132 and upper wall 136 may not necessarily be parallel with respect to one another but may be offset from one another at an offset angle.

Figure 3B:
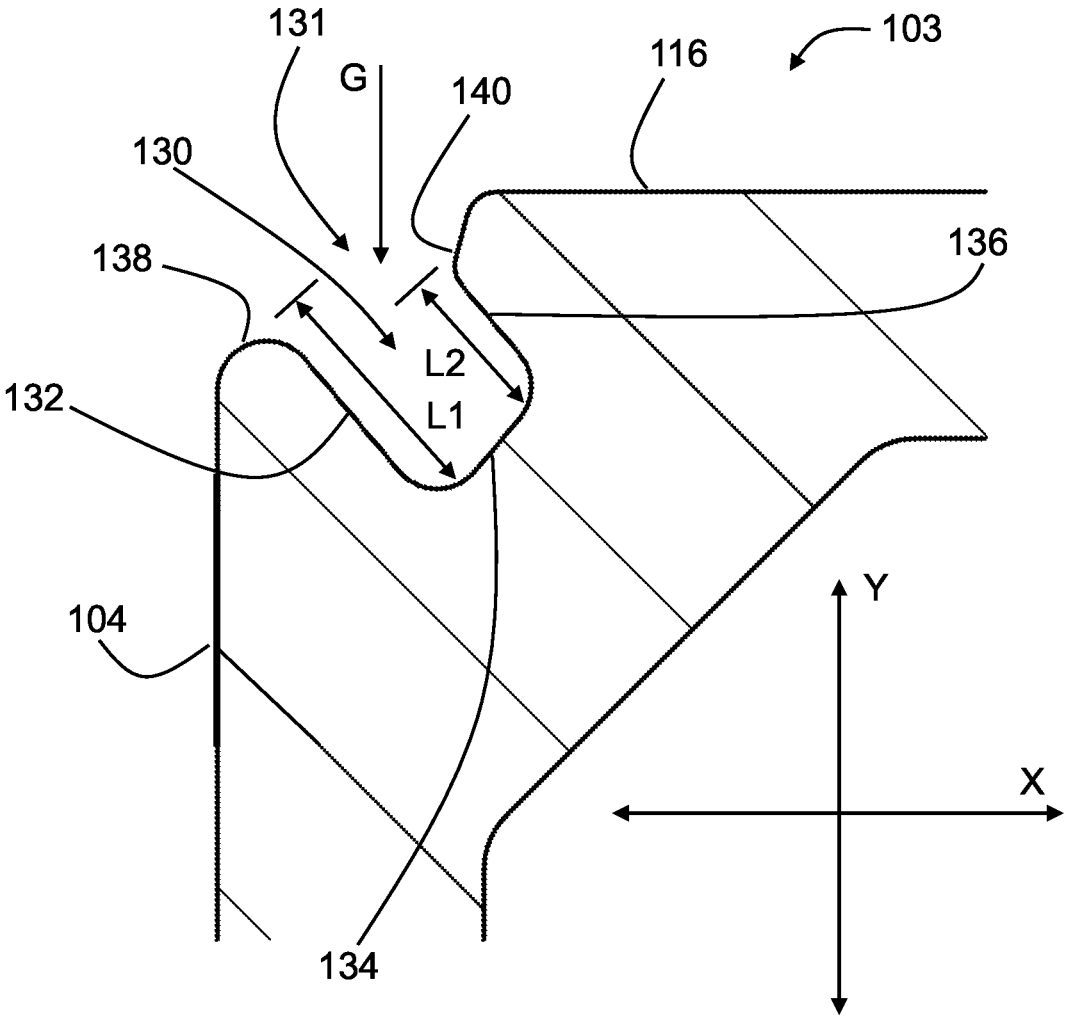

The intersection of the inboard inner wall 104 and the groove's lower wall 132 forms the groove's lower lip 138, and the intersection of the inboard top surface 116 and the groove's upper wall 136 forms the groove's upper lip 140. As shown in FIG. 3B, the length of the lower wall 132, measured from the lower lip 140 to the back wall 134, is represented as L1. The length of the upper wall 136, measured from the upper lip 140 to the back wall 134, is represented as L2.

In some embodiments, the length L1 of the lower lip 138 is generally equal to the length L2 of the upper lip 140 (L1=L2). In some embodiments as shown in FIG. 3B, the length L1 of the lower lip 138 is greater than the length L2 of the upper lip 140 (L1>L2). In some embodiments, the upper lip 140 may be truncated (the distal end portion of the tip may be removed) to reduce the length L2.

Figure 3C:
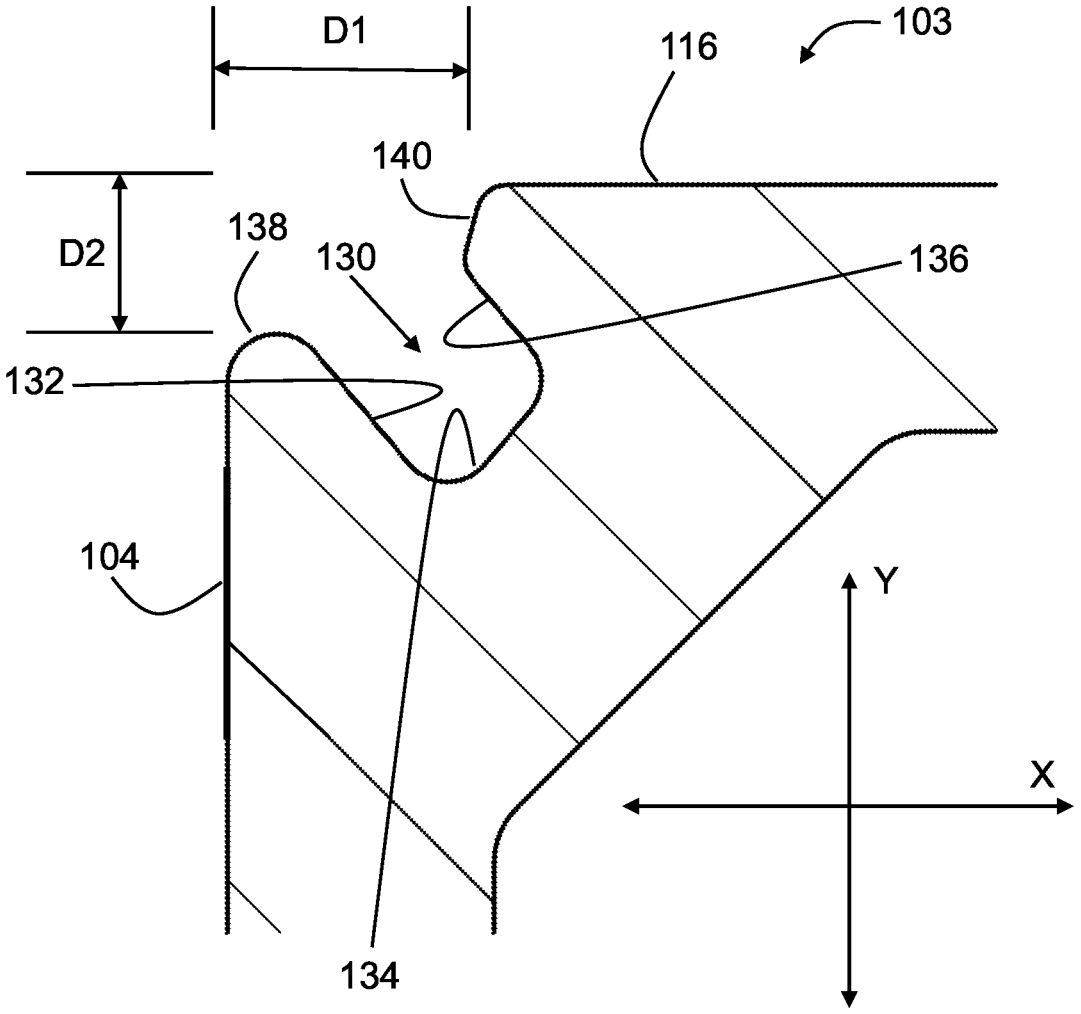

In any event, as shown in FIG. 3C, it is preferable that the upper lip 140 is laterally offset from the lower lip 138 in the direction away from the glass panel 120 as represented by the lateral offset distance D1. In some embodiments, the lateral offset distance D1 is in the range of 1 mm-5 mm. It is also preferable that the lower lip 138 is vertically offset from the inboard top surface 116 in the direction towards the bottom 118 of the base shoe 100 as represented by the vertical offset distance D2. In some embodiments, the vertical offset distance D2 is in the range of 1 mm-5 mm. In some embodiments as shown in FIG. 3C, the lateral offset distance D1 is greater than the vertical offset distance D2, while in other embodiments, the lateral offset distance D1 is equal to or less than the vertical offset distance D2. In any event, it is preferable that the architecture provides that at least a portion of the entrance 131 to the first seal retaining groove 130 is vertically accessible from directly above as represented by arrow G in FIG. 3B. That is, because the inboard top surface 116 does not extend in the X-plane to the X-plane position of the inboard inner wall 104, at least a portion of the entrance 131 to the first seal retaining groove 130 is exposed from directly above in the Y-plane.

In some exemplary embodiments hereof as shown in FIG. 2, a second seal retaining groove 142 is positioned at the intersection of the outboard inner wall 102 and the outboard top surface 112. In one exemplary embodiment hereof, the architecture and form of the second seal retaining groove 142 mirrors the architecture and form of the first seal retaining groove 130. It is understood that the details described herein or otherwise pertaining to the first seal retaining groove 130 also may pertain to the second seal retaining groove 142.

Figure 4:
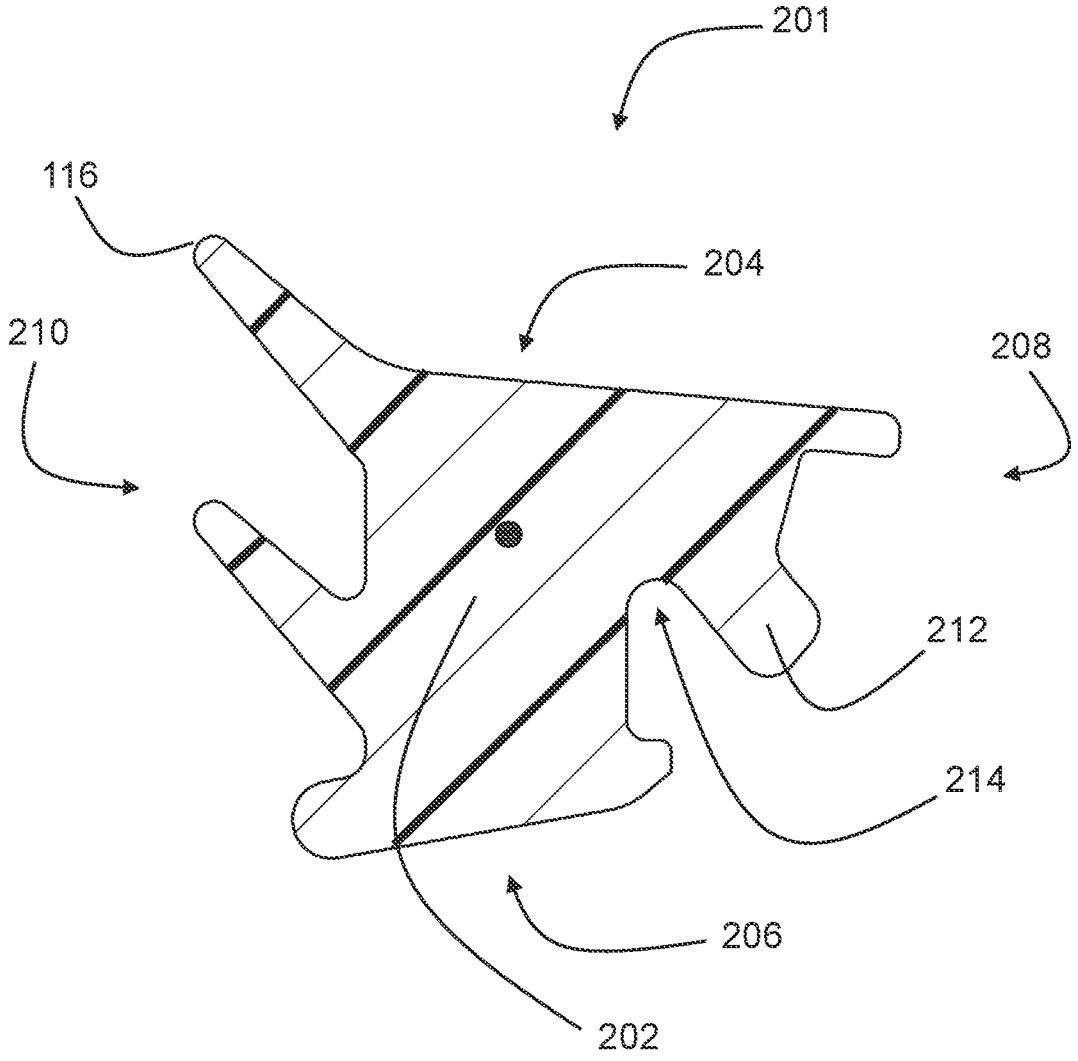
FIG. 4 shows aspects of a weather seal according to exemplary embodiments hereof.

In one exemplary embodiment hereof, the system 10 includes an inboard weather seal 201 adapted to be positioned within the inboard gap 128 while retained by the first seal retaining groove 130 (see FIG. 2). In some embodiments as shown in FIG. 4, the inboard weather seal 201 includes a body portion 202 having a top side 204, a bottom side 206, a lateral side 208 (shown to the right and generally facing away from the middle of the base shoe 100 when assembled) and a medial side 210 (shown to the left and generally facing towards from the middle of the base shoe 100 when assembled). A foot section 212 extends from the seal's lateral side 208 thereby forming a lower notch 214 between the foot 212 and the body portion 202.

Figure 5:
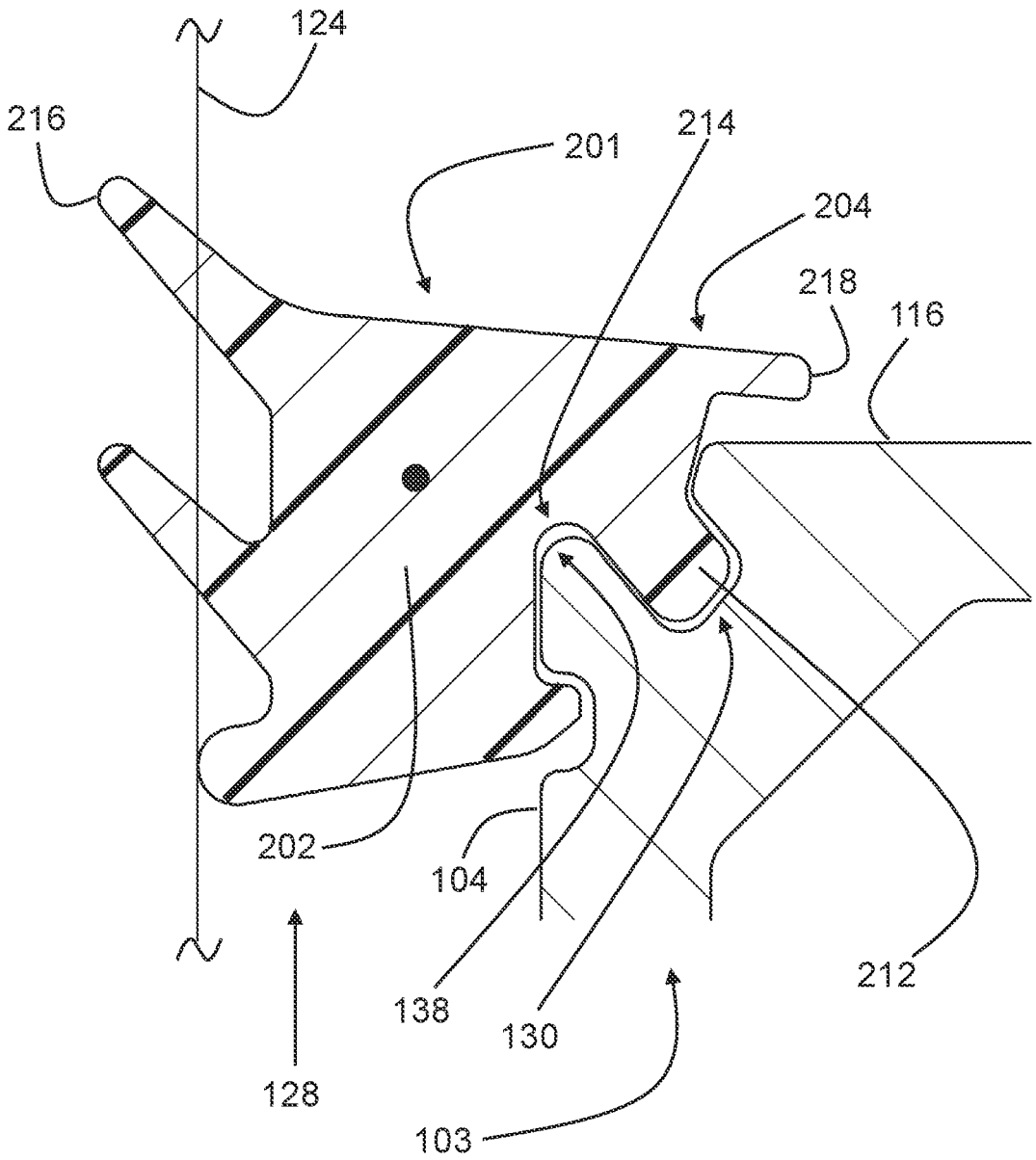
FIGS. 5-6 show aspects of a panel base shoe and weather seal system according to exemplary embodiments hereof.

In one exemplary embodiment hereof as shown in FIG. 5, when configured with the base shoe 100, the inboard weather seal's lower notch 214 rests upon the first seal retaining groove's lower lip 138. In this way, the lower lip 138 acts as a vertical stop to the inboard seal 201. In this configuration, the seal's foot section 212 extends into the first seal retaining groove 130 and is secured therein (e.g., by pressure fit). This acts to hold the inboard seal 201 in place. The seal's body portion 202 is positioned within the inboard gap 128 and is held therein (e.g., by pressure fit). In addition, at least one glass scraper seal 216 configured on the weather seal's medial side 210 interfaces with the inboard lateral surface 124 of the glass panel 120 thereby weatherproofing that junction. While FIG. 5 shows the glass scraper seal 216 as passing past the panel's inboard lateral surface 124, it is understood that FIG. 5 shows the glass scraper seal 216 as unflexed to show its general at-rest shape, and that the glass scraper seal 216 may flex (preferably upward) upon installation to accommodate the panel 120 (see FIG. 7)

Figure 6:
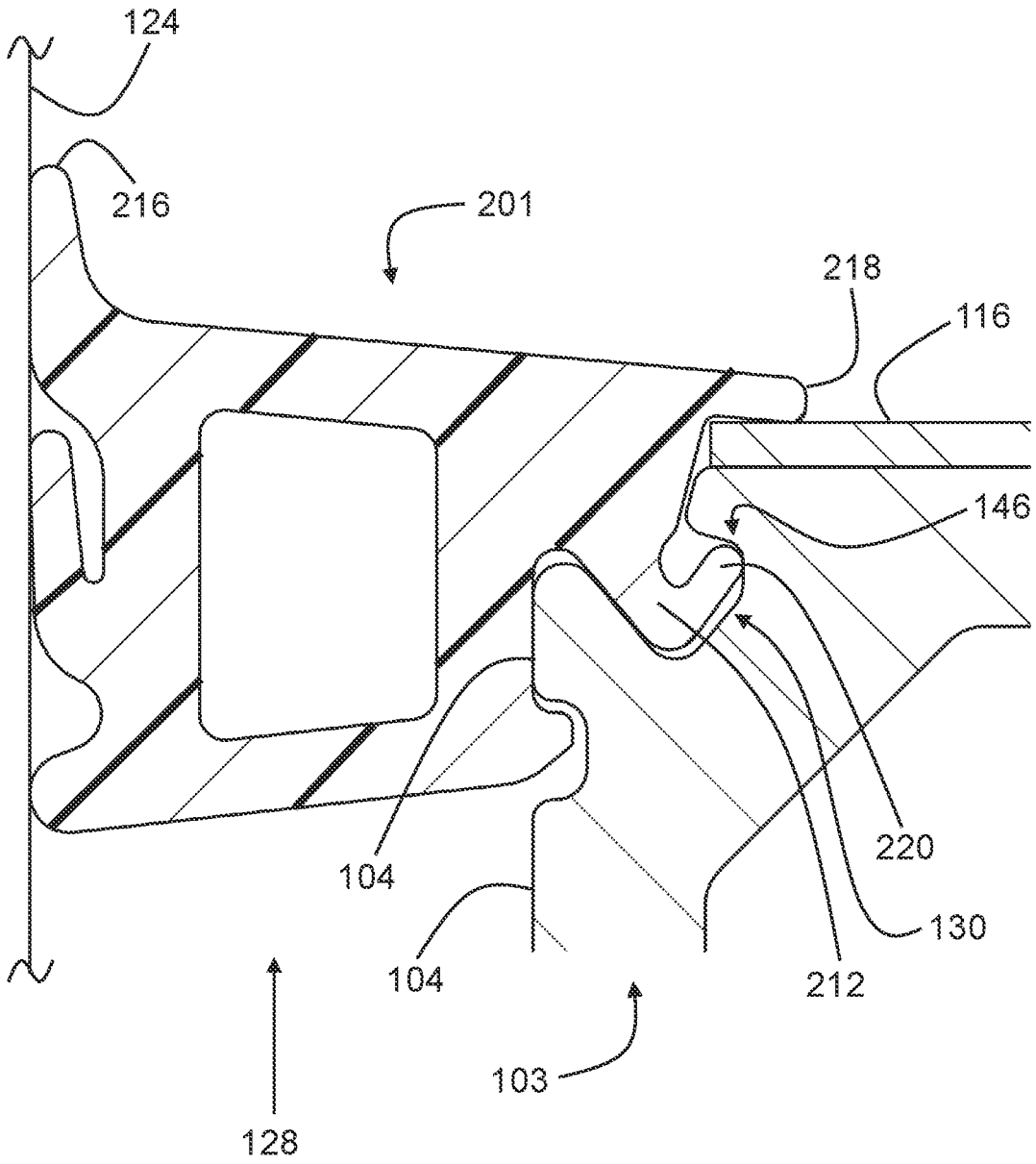

As described above, with the inboard weather seal 201 configured within the inboard gap 128 and retained by the first seal retaining groove 130, the seal's top side 204 may interface with the via an upper glass scraper seal 216. The top side 204 of the inboard seal 201 also may include a lateral top lip 218 on its lateral side 208 that may extend outward (away from the panel 120 and preferably horizontally) a distance over the inboard top surface 116 of the base shoe 100 thereby sealing that junction. In some embodiments, if a cladding 144 is present on the top surface 116 (e.g., as shown in FIG. 6), the lateral top lip 218 may extend across the top surface of the cladding 144 thereby sealing that junction. In any event, the lateral top lip 218 weatherproofs the top junction between the inboard weather seal 201 and the seal's inboard top surface 116 (and/or any cladding 144 that may be present).

In one exemplary embodiment hereof as shown in FIG. 6, the foot section 212 includes an elongate detent 220 adapted to extend into an upper notch 146 formed in the groove's upper wall 136. This detent 220 and notch 146 combination may further secure the foot section 212 within the seal retention groove 130.

Figure 7:
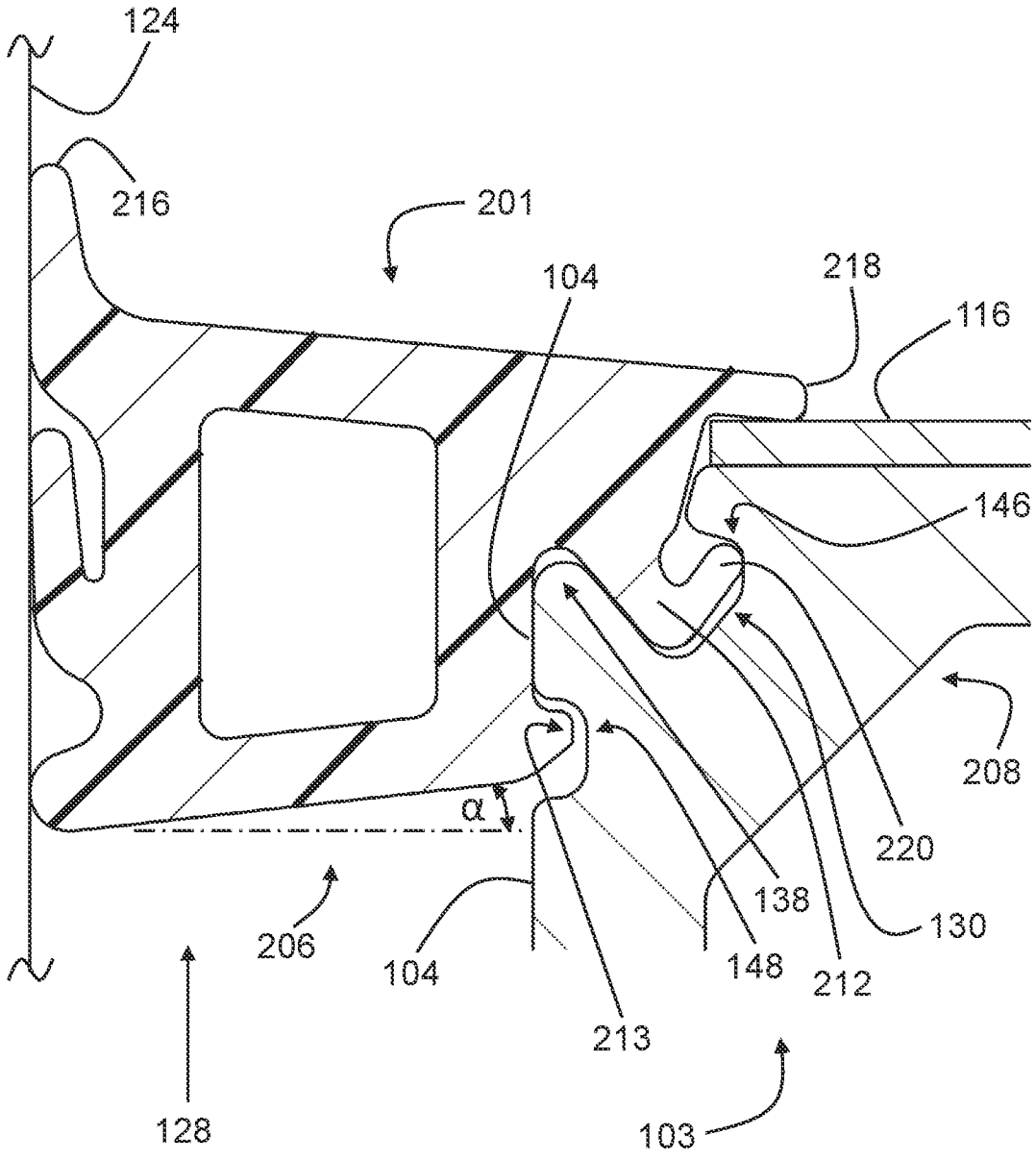
FIG. 7 shows aspects of a panel base shoe and weather seal system according to exemplary embodiments hereof.
Figure 8:
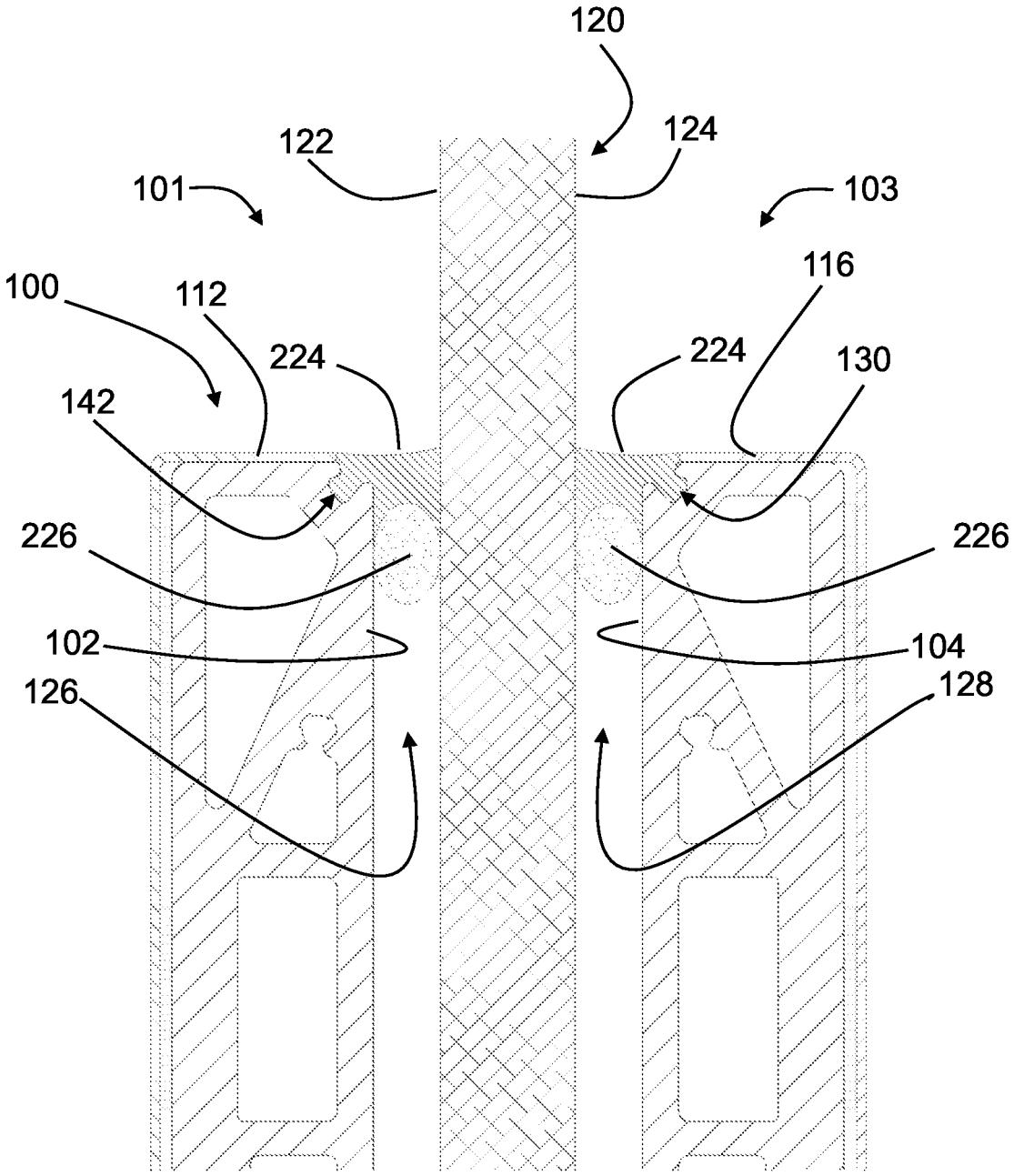
FIG. 8 shows aspects of a panel base shoe with sealant according to exemplary embodiments hereof.

In some embodiments hereof as shown in FIG. 7, a third seal retaining elongate groove 148 is positioned in the inboard inner wall 104 below the first seal retaining elongate groove 130. Similar to the first seal retaining groove 130, the third seal retaining groove 148 also preferably extends along the longitudinal length (as represented by the axis $L_L$ in FIG. 1) of the base shoe member 100. However, it is understood that the third seal retaining groove 148 may extend along separate and/or individual portions of the base shoe member's longitudinal length.

In some embodiments, the inboard weather seal 201 includes a lower foot 213 extending from the seal's lateral side 208 and adapted to be received into the third seal retaining groove 148 when the inboard weather seal 201 is configured with the base shoe 100 as shown. The abutment between the lower foot 213 and the third seal retaining groove 148 provides additional securement of the inboard weather seal 201 within the inboard gap 128.

In some exemplary embodiments hereof as shown in FIG. 2, a fourth seal retaining groove 150 is positioned in the outboard inner wall 102 below the second seal retaining groove 142. In one exemplary embodiment hereof, the architecture and form of the fourth seal retaining groove 150 mirrors the architecture and form of the third seal retaining groove 148. It is understood that the details described herein or otherwise pertaining to the third seal retaining groove 148 also may pertain to the fourth seal retaining groove 150.

In some embodiments as shown in FIG. 7, the bottom side 206 of the inboard weather seal 201 extends from the inboard lateral surface 124 of the glass panel 110 to the inboard inner wall 104 of the base shoe 100 at an upward acute angle $\alpha$. In some embodiments, the angle $\alpha$ is about 1°-10° and preferably about 3°-5°. However, other angles also may be used. In addition, the gasket's bottom side 206 may extend generally linearly from the inboard lateral surface 124 to the inboard inner wall 104, however, it is understood that the bottom side 206 also may include one or more curvatures. The angled bottom side 206 and the abutment between the lower foot 213 and the third seal retaining groove 148 may help to prevent the inboard weather seal 201 from folding, bunching up, rolling or otherwise becoming deformed when the glass panel 120 may undergo slight movements (e.g., slight up and/or down vertical movements) during its installation and positioning within the base shoe 100.

In one exemplary embodiment hereof, the system 10 includes an outboard weather seal 222 adapted to be positioned within the outboard gap 126 while retained by the second seal retaining groove 142 and the fourth seal retaining groove 150 (see FIG. 2). In one exemplary embodiment hereof, the architecture and form of the outboard weather seal 222 mirrors the architecture and form of the inboard weather seal 201. It is understood that the details described herein or otherwise pertaining to the inboard weather seal 201 also may pertain to the outboard weather seal 222.

In any of the embodiments herein, system 10 provides a corner-loading system wherein the weather seals 201, 222 may be installed into the gaps 128, 126 and first and second retaining grooves 130, 142, respectively, and third and fourth retaining grooves 148, 150, respectively, from an inclined angle from above. In this way, the weather seals 201, 222 may be installed prior to the installation of the glass panel 120 or after the installation of the glass panel 120. This is in contrast to the top loading functionalities and/or vertical face loading functionalities of prior art.

In one exemplary embodiment hereof as shown in FIG. 7, a gel-based sealant 224 (e.g., silicon sealant or caulking) may be used to provide a weather seal between the base shoe 100 and the glass panel 120. The sealant 224 may be used in addition to or instead of the one or more weather seals 201, 222. A backer rod 226 (comprising a flexible length of foam or similar with a generally round or oval shaped cross-section) may be placed within the outboard gap 126 and/or the inboard gap 128 between the glass panel 110 and the outboard inner wall 102 and/or the inboard inner wall 104 of the base shoe 100 respectively. The sealant 224 may then be placed within each gap 126, 128 and the backer rod 226 may act as a vertical stop (a back stop) within each gap 126, 128 to provide a bottom for the filling. The backer rod may be placed within each gap 126, 128 along the length of the glass panel 110 and base shoe 100 using a rolling tool with a depth control to position the backer rod at a uniform desired depth.

In one exemplary embodiment hereof, once the sealant 224 has been administered, the sealant 224 extends from the backer rod 226 within each gap 126, 128 upward and into the first and second seal retaining grooves 130, 142 and the third and fourth seal retaining grooves, 148, 150, respectively. The top surface of the sealant 224 is generally flush with the inboard top surface 116 on the inboard side and with the outboard top surface 112 on the outboard side, however the top surface of the sealant 224 may be above or below the top surfaces 116, 112 depending on the application, shrinkage during curing, etc.

In this configuration and once cured, the hardened sealant 224 is mechanically retained within each seal retaining groove 130, 142, 148, 150 and gap 126, 128. In some embodiments, the lateral offset D1 of the upper lip 140 with respect to the lower lip 138 and/or the vertical offset D2 of the lower lip 138 with respect to the inboard top surface 116 (best seen in FIG. 3C) provides a sufficient volume (thickness) of sealant 224 between the seal retaining grooves 130, 142 and the top surface of the sealant 224 to provide sufficient mechanical integrity to the hardened sealant 224. It is understood that a similar effect is provided by the second seal retaining groove 142 positioned at the intersection of the outboard inner wall 102 and the outboard top surface 112 for sealant 224 administered into the outboard gap 126.

Benefits of the System

The benefits of the system 10 are multifold and include, without limitation:

First, the system 10 allows for the use of an identical weather seal 201, 222 on both the outboard gap 126 and the inboard gap 128, thus reducing the number of parts that an installer (glazier) is required to stock and carry.

Second, the weather seals 201, 222 may be installed prior to or after the installation of the glass panel 120. In one example, the outboard weather seal 222 may be installed prior to the installation of the glass panel 120 (e.g., on the drop side) thereby eliminating the sometimes-dangerous task of installing the drop side weather seal 222 after the glass panel 120 is in place (which would require the glazier to lean over the glass panel or to stand on an outer scaffolding). Then once the outboard seal 222 and the glass panel 120 are both installed, the inboard weather seal 201 may be installed from above.

Third, because the seal retaining grooves 130, 142 are positioned at an upward inclined angle CD, the system 10 allows for easy access to the grooves 130, 142 from above. This may be beneficial for the cleaning of the grooves 130,142 when necessary. For example, if the silicon sealant 224 used to weather seal the gaps 126, 128 needs replacing, the worn sealant 224 within the gaps 126,128 may be removed with easy access from above. In another example, if the glass panel 220 is secured within the base shoe member 100 using epoxy or cement, any epoxy or cement that inadvertently gets into the grooves 130, 142 may be removed from above.

Fourth, when silicon sealant 224 is used to seal the gaps 126, 128, the angled seal retaining grooves 130, 142 provide ample volume for the sealant 224 to be retained.

It is understood that any aspects and/or elements of any embodiment(s) of the system 10 described herein may be combined with any aspects and/or elements of any other embodiment(s) described herein to form new embodiment(s) all of which are within the scope of the system 10.

It is understood that the benefits shown above are meant for demonstration and that other benefits of the system 10 may also exist. Those of ordinary skill in the art will appreciate and understand, upon reading this description, that embodiments hereof may provide different and/or other advantages, and that not all embodiments or implementations need have all advantages.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent, or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. A system configured to seal a gap between a base shoe portion and a panel, the base shoe portion including an inner side wall and the panel including a first surface opposing the inner side wall, the system comprising:

a first elongate groove formed in the base shoe inner side wall and including a first groove entrance defined by a groove upper lip and a groove lower lip, a first groove back side opposite the first groove entrance and a first groove bottom surface that extends from the first groove lower lip to the first groove back side at a reflex angle relative to the inner side wall; and a first elongate seal configured to extend from the base shoe inner side wall to the panel and including a first foot adapted to be received into the first elongate groove;

wherein the groove upper lip is recessed from the groove lower lip such that at least a portion of the first groove entrance is vertically accessible from directly above the first elongate groove.

2. The system of claim 1 wherein the first elongate groove includes a top wall oriented at a downward acute angle with respect to the base shoe inner side wall.

3. The system of claim 1 wherein the first elongate groove includes a top wall, the system further comprising:

an elongate upper notch formed in the top wall; and an elongate detent configured with the first foot and adapted to engage the elongate upper notch.

4. The system of claim 1 further comprising:

a second elongate groove formed in the base shoe inner side wall below the first groove entrance; and a second foot configured with the first elongate seal and adapted to be received into the second elongate groove.

5. The system of claim 1 wherein the first elongate seal includes a bottom side adapted to extend from the base shoe inner side wall to the panel at an obtuse angle with respect to the base shoe inner side wall.

6. The system of claim 1 further comprising:

a lower lip formed in the inner side wall at an intersection of the inner side wall and the first groove entrance; and a lower notch formed below the first foot in the first elongate seal;

wherein the lower notch is adapted to engage the lower lip.

7. The system of claim 1 wherein the base shoe portion includes a top side, the system further comprising:

an upper lip configured with the first elongate seal and extending from the first elongate seal towards the top side;

wherein the upper lip is adapted to overlap at least a portion of the top side.

8. The system of claim 1 further comprising:

a glass scraper seal configured with the first elongate seal and adapted to engage the panel.

9. A system configured to seal a gap between a base shoe portion and a panel, the base shoe portion including an inner side wall at a first position in a horizontal plane and a top side, and the panel including a first surface opposing the inner side wall, the system comprising:

a first elongate groove formed at an intersection of the base shoe inner side wall and the base shoe top side, the first groove including a first groove entrance defined by a groove upper lip and a groove lower lip, and a first groove back side opposite the first groove entrance and a first groove bottom surface that extends from the first groove lower lip to the first groove back side at a reflex angle relative to the inner side wall;

a first elongate seal configured to extend from the base shoe inner side wall to the panel and including a first foot adapted to be received into the first elongate groove;

wherein the top side terminates at a second position in the horizontal plane laterally offset from the first position in a direction away from the panel such that at least a portion of the first groove entrance is vertically accessible from directly above the first elongate grooves.

10. The system of claim 9 wherein at least a portion of the first groove entrance is vertically accessible from directly above the first elongate groove.

11. The system of claim 9 wherein the first elongate groove includes a top wall oriented at a downward acute angle with respect to the base shoe inner side wall.

12. The system of claim 9 wherein the first elongate groove includes a top wall, the system further comprising:

an elongate upper notch formed in the top wall; and an elongate detent configured with the first foot and adapted to engage the elongate upper notch.

13. The system of claim 9 further comprising:

a second elongate groove formed in the base shoe inner side wall below the first groove; and a second foot configured with the first elongate seal and adapted to be received into the second elongate groove.

14. The system of claim 9 wherein the first elongate seal includes a bottom side adapted to extend from the base shoe inner side wall to the panel at an obtuse with respect to the base shoe inner side wall.

15. The system of claim 9 wherein the first groove includes a first groove entrance, the system further comprising:

a lower lip formed in the inner side wall at an intersection of the inner side wall and the first groove entrance; and a lower notch formed below the first foot in the first elongate seal;

wherein the lower notch is adapted to engage the lower lip.

16. The system of claim 9 further comprising:

an upper lip configured with the first elongate seal and extending from the first elongate seal towards the top side;

wherein the upper lip is adapted to overlap at least a portion of the top side.

17. The system of claim 9 further comprising:

a glass scraper seal configured with the first elongate seal and adapted to engage the panel.

* * * * *